US007918678B2

(12) United States Patent
Cole et al.

(10) Patent No.: US 7,918,678 B2
(45) Date of Patent: Apr. 5, 2011

(54) CONNECTOR ASSEMBLIES HAVING GUIDE RAILS WITH LATCH ASSEMBLIES

(75) Inventors: Jordan Marshall Cole, San Jose, CA (US); Robert Paul Nichols, San Carlos, CA (US); Brian Patrick Costello, Scotts Valley, CA (US); Edward John Bright, Middletown, PA (US); Harold William Kerlin, Port Royal, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/211,950

(22) Filed: Sep. 17, 2008

(65) Prior Publication Data

US 2010/0068912 A1 Mar. 18, 2010

(51) Int. Cl.
*H01R 13/627* (2006.01)

(52) U.S. Cl. ..... 439/328; 439/64; 439/377

(58) Field of Classification Search ..... 439/327, 439/328, 357, 358, 350, 153, 155, 157, 159, 439/160, 152, 377, 372, 64, 540.1, 541.5
See application file for complete search history.

(56) References Cited

U.S. PATENT DOCUMENTS

| | | | | |
|---|---|---|---|---|
| 4,941,841 | A * | 7/1990 | Darden et al. | 439/377 |
| 6,587,350 | B1 * | 7/2003 | Lin et al. | 439/159 |
| 6,831,832 | B2 * | 12/2004 | Haager et al. | 439/159 |
| 6,916,196 | B2 | 7/2005 | Long et al. | |
| 6,992,886 | B2 * | 1/2006 | Salinas et al. | 361/679.38 |
| 7,077,686 | B2 | 7/2006 | Seo et al. | |
| 7,090,523 | B2 | 8/2006 | Shirk et al. | |
| 7,626,813 | B2 * | 12/2009 | Weng et al. | 361/724 |

* cited by examiner

*Primary Examiner* — Felix O Figueroa

(57) ABSTRACT

A connector assembly for mating with a pluggable module includes a receptacle assembly for receiving the pluggable module and an interface electrical connector defining a back of the receptacle assembly. The interface electrical connector is configured to mate with the pluggable module. A guide rail defines a side of the receptacle assembly. The guide rail is configured to guide the pluggable module within the receptacle assembly. The guide rail has a rail body having a cavity and the rail body having a side wall opening open to the cavity. A latch assembly is received in the cavity. The latch assembly includes a latch movable between a latched position and an unlatched position. The latch is configured to extend through the side wall opening to engage the pluggable module when the latch is in the latched position. The latch assembly further includes an actuator that forces the latch from the latched position to the unlatched position.

14 Claims, 6 Drawing Sheets

CONNECTOR ASSEMBLIES HAVING GUIDE RAILS WITH LATCH ASSEMBLIES

BACKGROUND OF THE INVENTION

The subject matter herein relates generally to connector assemblies, and more particularly to latch assemblies for pluggable modules and/or transceivers.

Various types of fiber-optic and copper based pluggable modules or transceivers that permit communication between electronic host equipment and external devices are known. These pluggable modules may be incorporated into connector assemblies that can be pluggably connected to the host equipment to provide flexibility in system configuration. The pluggable modules may be constructed according to various standards for size and compatibility. The pluggable modules are plugged into a receptacle assembly that is mounted on a circuit board within the host equipment. The receptacle assembly typically includes an elongated guide frame having a front that is open to an interior space, and an electrical connector disposed at the rear of the receptacle within the interior space for mating with the pluggable module. Typically, latch mechanisms are used to secure the pluggable module within the receptacle assembly.

Known latch mechanisms are not without disadvantages, however. For instance, the latch mechanisms typically include an actuator that is slidably mounted in a slot formed in the pluggable module. The actuator includes a ramped portion for engaging and displacing a latch tab on the structure defining the receptacle. The actuator increases the overall size and complexity of the pluggable module. In some known systems; the latch mechanism is not readily accessible and the actuator is positioned behind the front face of the device when the actuator is in both the operative and inoperative positions. Accordingly, a special tool or probe must be inserted into the slot and/or between adjacent modules to access and press the actuator. The requirement of a tool for removing the pluggable module is not only inconvenient, but also prevents an operator from removing the module if he or she does not have a suitable tool at the appropriate time. The requirement of a tool results in increased installation cost and/or repair time.

A need remains for a latch mechanism that is provided in a cost-effective and reliable manner. A need remains for a latch mechanism that may be incorporated within the connector assembly with minimal impact to the overall size of the connector assembly.

BRIEF DESCRIPTION OF THE INVENTION

In one embodiment, a connector assembly is provided for mating with a pluggable module. The connector assembly includes a receptacle assembly for receiving the pluggable module and an interface connector defining a back of the receptacle. The interface electrical connector is configured to mate with the pluggable module. A guide rail defines a side of the receptacle. The guide rail is configured to guide the pluggable module within the receptacle assembly. The guide rail has a rail body having a cavity and the rail body has a side wall opening open to the cavity. A latch assembly is received in the cavity. The latch assembly includes a latch movable between a latched position and an unlatched position. The latch is configured to extend through the side wall opening to engage the pluggable module when the latch is in the latched position. The latch assembly further includes an actuator that forces the latch from the latched position to the unlatched position.

Optionally, the actuator may engage the latch internal to the rail body such that a portion of the actuator is configured to extend from the rail body and a portion of the latch is configured to extend from the rail body. The latch may lock the pluggable module within the receptacle assembly when the latch is in the latched position. Optionally, the connector assembly may also include a substrate, where the guide rail and the interface connector are mounted to a side of the substrate. Optionally, the electrical connector assembly may also include a second guide rail defining an opposite side of the receptacle, where the second guide rail is substantially identically formed as the other guide rail. The second guide rail may have a first side and a second side, where the first side faces the other guide rail and is configured to guide the pluggable module within the receptacle assembly, and where the second side defines a side of a second receptacle assembly and is configured to guide a second pluggable module within the second receptacle assembly.

Optionally, the guide rail may include a pin extending into the cavity, and the actuator may include an elongated slot that receives the pin. The pin may guide the actuator in a linear actuation direction. The latch may be pivoted between the latched position and the unlatched position about the pin. The latch may include a peg extending outward therefrom, and the actuator may include a ramp surface, where the peg rides along with a ramp surface as the actuator is actuated to move the latch relative to the side wall opening.

In another embodiment, a guide rail for guiding a pluggable module is provided that includes a rail body extending along a rail axis between a front end and a back end. The rail body has a cavity proximate to the front end and the rail body has a side wall opening open to the cavity. A latch assembly is received in the cavity and includes a latch movable between a released position and a latched position. The latch is configured to extend through the side wall opening to engage the pluggable module in the latched position. The latch assembly further includes an actuator that forces the latch from the latched position to the released position.

In a further embodiment, a connector assembly for mating with pluggable modules is provided that includes a substrate having a first side and a second side. The connector assembly also includes interface connectors mounted to the substrate that are configured to mate with the pluggable modules. Guide rails are mounted to the substrate and are configured to guide the pluggable modules to the interface connectors. Each guide rail has a rail body having a cavity and a side wall opening open to the cavity. Latch assemblies are received in corresponding cavities. Each latch assembly includes a latch movable between a latched position and an unlatched position, and each latch is configured to extend through the corresponding side wall opening to engage the corresponding pluggable module. Each latch assembly further includes an actuator that forces the latch from the latched position to the unlatched position.

DETAILED DESCRIPTION OF THE INVENTION

Figure 1:
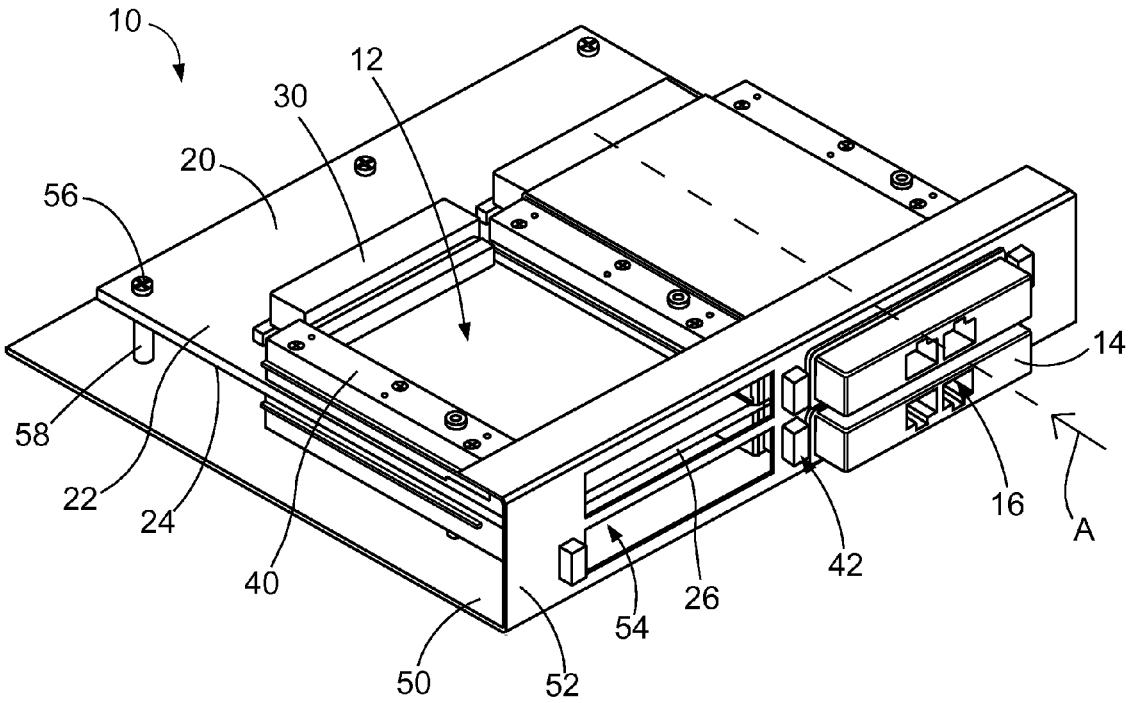
FIG. 1 illustrates a connector assembly having a plurality of receptacle assemblies that receive pluggable modules therein.

FIG. 1 illustrates a connector assembly 10 having a plurality of receptacle assemblies 12 that receive pluggable modules 14 therein. In an exemplary embodiment, the connector assembly 10 constitutes an input/output assembly for a device such as a computer or network switch. The pluggable modules 14 may represent line cards or transceiver modules that are pluggable into the receptacles 12, but are not limited thereto. The pluggable modules 14 include ports 16 for interfacing with data cables, such as communication cables. Optionally, the data cables may be copper wire data cables or alternatively may be fiber-optic data cables. The connector assembly 10 illustrated in FIG. 1 shows four receptacles 12 with two of the receptacles 12 having pluggable modules 14 therein. Any number of receptacles 12 may be provided and any number of the receptacles 12 may have pluggable modules 14 therein.

The connector assembly 10 includes a substrate 20, which is represented in the illustrated embodiment by a circuit board. The substrate 20 includes a first side 22 and a second side 24. The substrate 20 also includes a front edge 26. Optionally, the receptacles 12 may be provided on both sides 22, 24 of the substrate 20, however the receptacles 12 may be provided on only one of the sides 22 or 24 in alternative embodiments. In an exemplary embodiment, the substrate 20 defines a side of each receptacle 12. Alternatively, another component may extend along the substrate 20 and define a portion of the receptacle 12. For example, a frame or housing may be supported by the substrate 20 and define the receptacle 12.

The connector assembly 10 includes a plurality of interface connectors 30 corresponding to respective receptacles 12. The interface connectors 30 may be mounted directly to the substrate 20, or alternatively may be indirectly supported by or positioned proximate to the substrate 20. In an exemplary embodiment, the interface connectors 30 are mechanically and electrically coupled to the substrate 20. Optionally, the interface connectors 30 are positioned along and/or define a back of the respective receptacles 12. The interface connectors 30 mate with the pluggable modules 14 when the pluggable modules 14 are loaded into the receptacles 12.

The connector assembly 10 includes a plurality of guide rails 40. Optionally, the guide rails 40 are mounted directly to the substrate 20, or alternatively may be indirectly supported by or positioned proximate to the substrate 20. The guide rails 40 may be positioned on both sides 22, 24 of the substrate 20. In an exemplary embodiment, a pair of the guide rails 40 define opposite sides of each receptacle assembly 12. The guide rails 40 operate to guide the pluggable modules 14 into the corresponding receptacle assemblies 12. For example, as will be described in further detail below, the pluggable modules 14 engage the guide rails 40 when the pluggable modules 14 are loaded into the receptacle assemblies 12. The guide rails 40 guide the pluggable modules 14 to the corresponding interface connectors 30 in a loading direction along a loading axis, shown generally along the arrow A.

In an exemplary embodiment, the guide rails 40 are configured to have latch assemblies 42 integrated therewith for locking the pluggable modules 14 within the receptacle assemblies 12. The latch assemblies 42 may be operated by a user to release the pluggable modules 14 from the receptacle assemblies 12.

In an exemplary embodiment, the connector assembly 10 includes a frame 50 that supports the other components of the connector assembly 10. The frame 50 has a front face 52 defining a mating interface of the connector assembly 10. The front face 52 has a plurality of openings 54 therethrough. The openings 54 define ports that provide access to the receptacles 12. The pluggable modules 14 are loaded into the receptacles 12 through the openings 54. Optionally, the substrate 20 is mounted to the frame 50 using fasteners 56 and/or standoffs 58. In an exemplary embodiment, at least a portion of the latch assemblies 42 extend through the front face 52 and are accessible by the user. The frame 50 may be coupled to the device such that the front face 52 is exposed and accessible by the user.

Figure 2:
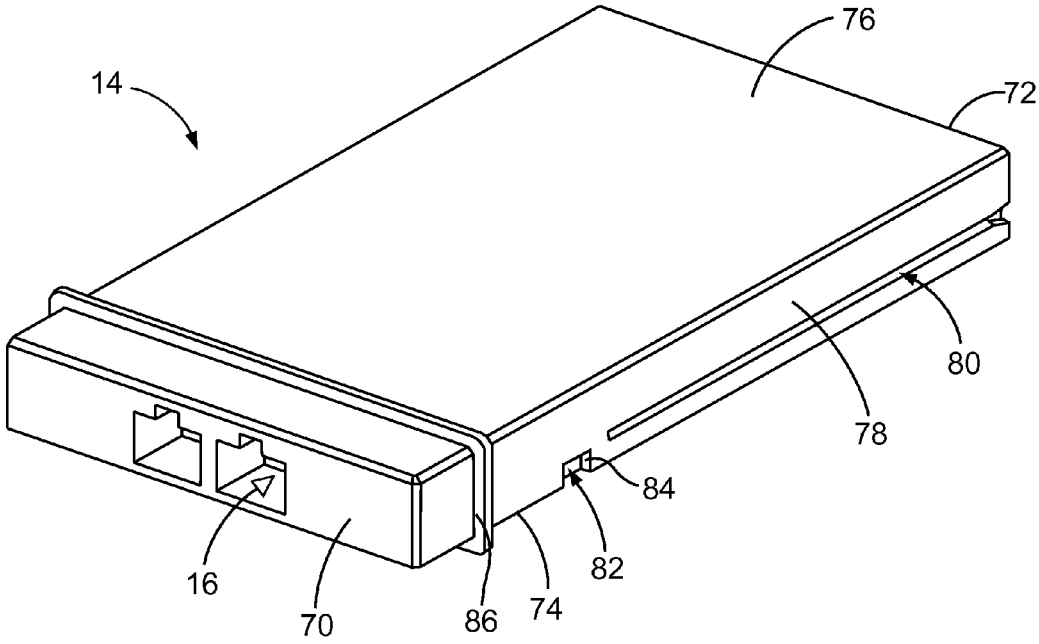
FIG. 2 is a side perspective view of one of the pluggable modules shown in FIG. 1.

FIG. 2 is a side perspective view of one of the pluggable modules 14. The pluggable module 14 has a front mating face 70 and a rear mating face 72. The rear mating face 72 is configured to be mated with the interface electrical connectors 30 (shown in FIG. 1). The front mating face 70 has the ports 16 that receive mating plugs (not shown). The mating plugs communicate with the interface connector 30 via the pluggable module 14.

The pluggable module 14 includes an inner surface 74 and an outer surface 76. When the pluggable module 14 is loaded into the receptacle assembly 12 (shown in FIG. 1), the inner surface 74 generally faces the substrate 20 (shown in FIG. 1) and the outer surface 76 generally faces away from the substrate 20. Side surfaces 78 extend between the inner and outer surfaces 74, 76. In the illustrated embodiment, the pluggable module 14 has a generally box-shaped body, however other shapes are possible in alternative embodiments.

Guide slots 80 may be formed in one or both of the side surfaces 78. The guide slots 80 extend from, and are open at, the rear mating face 72. Optionally, the guide slots 80 may be chamfered at the rear mating, face 72. As will be explained in further detail below, the guide: slots 80 interact with the guide rails 40 (shown in FIG. 1) for guiding the pluggable module 14 within the receptacle assembly 12.

In an exemplary embodiment, at least one of the side surfaces 78 include a latch detent 82 formed therein. The latch detent 82 includes a stop surface 84. As will be explained in further detail below, the latch detent 82, and more particularly the stop surface 84, interacts with the latch assembly 42 (shown in FIG. 1) for locking the pluggable module 14 within the receptacle 12.

The pluggable module 14 may include a flange 86 extending outward from at least one of the inner surface 74, the outer surface 76 and/or the side surfaces 78. When the pluggable module 14 is loaded into the receptacle 12, the flange 86 engages the frame 50 (shown in FIG. 1) to define a stop for the loading of the pluggable module 14 into the receptacle assembly 12. The flange 86 positions the pluggable module 14 with respect to the receptacle assembly 12.

Figure 3:
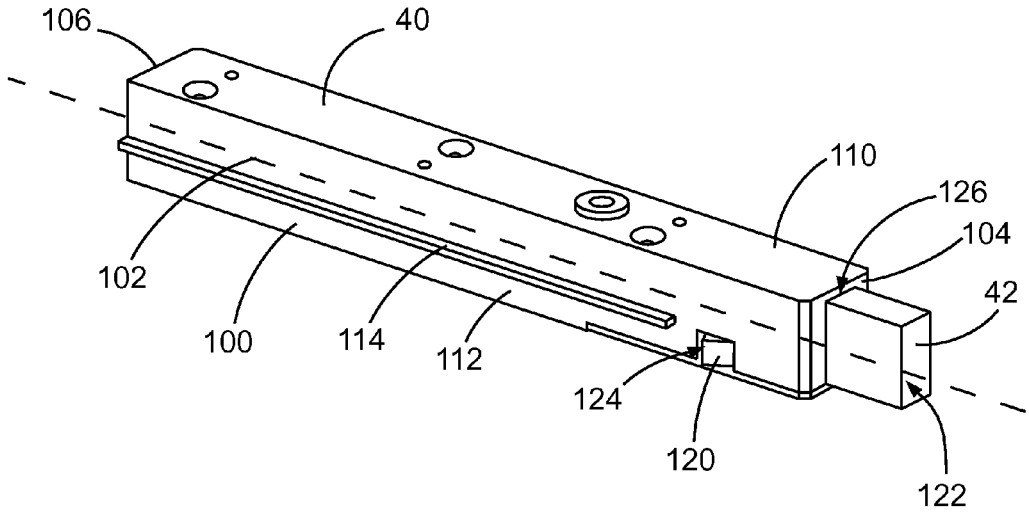
FIG. 3 as a side perspective view of a guide rail for the connector assembly that is formed in accordance with an exemplary embodiment.

FIG. 3 as a side perspective view of one of the guide rails 40 for the connector assembly 10 (shown in FIG. 1). The guide rail 40 includes a rail body 100 extending along a rail axis 102 between a front end 104 and a back end 106. When mounted to the substrate 20 (shown in FIG. 1), the front end 104 generally faces the front face 52 of the frame 50 (shown in FIG. 1) and the back end 106 generally faces the interface connector 30.

The guide rail 40 includes an inner surface 108 and an outer surface 110. When mounted to the substrate 20, the inner surface 108 generally faces the substrate 20 and the outer surface 110 generally faces away from the substrate 20. Side surfaces 112 extend between the inner and outer surfaces 108, 110. In the illustrated embodiment, the rail body 100 is generally box-shaped, however other shapes are possible in alternative embodiments.

Guide rib(s) 114 may be formed on one or both of the side surfaces 112. The guide rib 114 may extend from the back end 106 generally along the rail axis 102. The guide rib 114 is positioned, sized and/or shaped to fit within a corresponding guide slot 80 of the pluggable module 14 (shown in FIG. 2).

FIG. 3 also illustrates the latch assembly 42 at the front end 104 of the guide rail 40. The latch assembly 42 includes a latch 120 and an actuator 122 that interacts with the latch 120, as will be described in further detail below. The rail body 100 includes a side wall opening 124 and an end wall opening 126 at the front end 104. In the illustrated embodiment, the side wall opening 124 is positioned proximate to the front end 104 and the inner surface 108. The side wall opening 124 may be positioned differently in alternative embodiments. In an exemplary embodiment, at least a portion of the latch 120 extends through the side wall opening 124 and is exposed external to the guide rail 40. The latch 120 is configured to interact with the pluggable module 14 to lock the pluggable module 14 within the receptacle assembly 12. Additionally, at least a portion of the actuator 122 extends through the end wall opening 126 and is exposed external to the guide rail 40. The actuator 122 is positioned such that the actuator 122 is exposed to the user for actuation.

Figure 4:
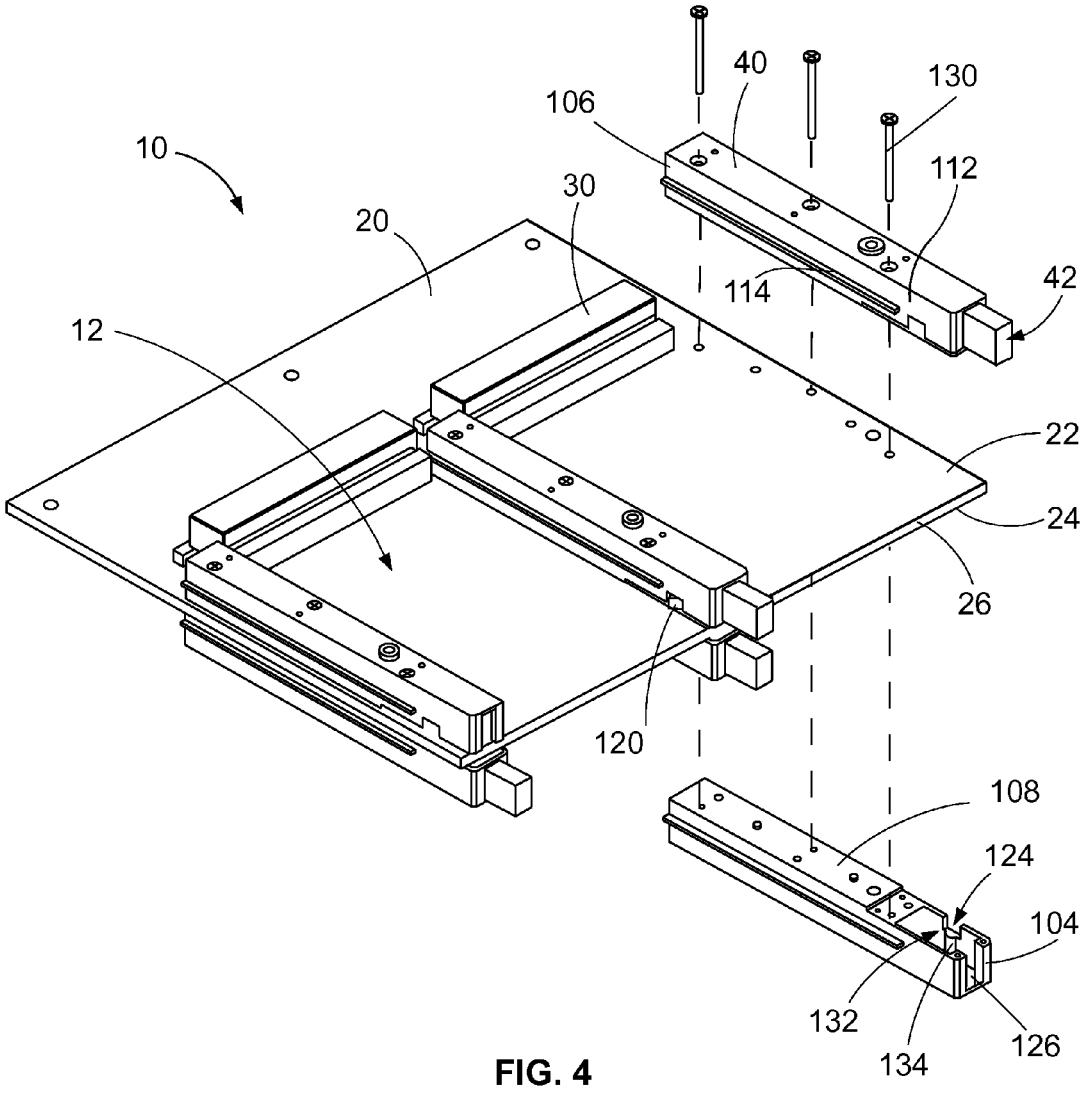
FIG. 4 illustrates a pair of guide rails being mounted to a substrate of the connector assembly shown in FIG. 1.

FIG. 4 illustrates a pair of guide rails 40 being mounted to the substrate 20 of the connector assembly 10. The guide rails 40 are secured to the substrate 20 using fasteners 130. Optionally, the guide rails 40 may be mounted directly to the substrate 20 such that the inner surfaces 108 engage one of the sides 22, 24 of the substrate 20. The interface connectors 30 may be mounted to the substrate 20 proximate to the back ends 106 of the guide rails 40. The guide rails 40 may be mounted to the substrate 20 such that the front end 104 of each guide rail 40 is positioned proximate to the front edge 26 of the substrate 20. At least a portion of the guide rail 40 and/or latch assembly 42 may extend beyond the front edge 26 of the substrate 20. In an exemplary embodiment, each guide rail 40 includes a cavity 132 proximate to the front end 104. The cavity 132 receives the latch assembly 42 therein. The side wall opening 124 and the end wall opening 126 both open to the cavity 132. In an exemplary embodiment, a pin 134 extends into the cavity 132.

In the illustrated embodiment, each receptacle assembly 12 is defined by a pair of guide rails 40 on respective sides of the receptacle assembly 12 and the interface connector 30 defining the back of the receptacle assembly 12. The front of the receptacle assembly 12 is open to provide access to the receptacle assembly 12 for the pluggable module 14 (shown in FIG. 1). The substrate 20 may define an inner side of the receptacle assembly 12 and the outer side of the receptacle assembly 12 may be open. Optionally, a separate component may be provided along the outer side of the receptacle assembly 12. For example, a heat sink may be provided along the outer side of the receptacle assembly 12. Alternatively, a shield element may be provided along the outer side of the receptacle assembly 12. In other alternative embodiments, a housing may be provided around at least a portion of the receptacle 12. The housing may have at least one wall that defines the receptacle assembly 12. Optionally, the guide rails 40 and/or at least a portion of the interface connector 30 may be integrally formed with the housing defining the receptacle 12. Alternatively, the housing may surround the guide rails 40 and/or at least a portion of the interface connector 30.

Each guide rail 40 may be substantially identical to each other guide rail 40. The guide rails 40 may be used on either side of the receptacle assemblies 12. In an exemplary embodiment, both side surfaces 112 of each guide rail 40 include a guide rib 114. As such, the guide rail 40 may be positioned between two receptacle assemblies 12 and guide two different pluggable modules 14 within the respective receptacle assemblies 12. Each latch assembly 42 is associated with a single receptacle assembly 12. For example, the latch 120 of the latch assembly 42 extends into a single receptacle assembly 12 for engaging a single pluggable module 14. Optionally, some of the guide rails 40 may be mounted to the substrate 20 without a latch assembly 42. For example, in the illustrated embodiment, three of guide rails 40 are provided oh the first side of 22 of the substrate 20, which define two receptacles 12 on the first side 22 of the substrate 20. The right-most guide rail 40 includes a latch assembly 42 with a latch 120 extending into the right-most receptacle assembly 12. The middle guide rail 40 includes a latch assembly 42 with a latch 120 extending into the left-most receptacle assembly 12. The left-most guide rail 40 does not include a latch assembly 42 as no receptacle assembly 12 is provided to the left of the left-most guide rail 40.

Optionally, the connector assembly 10 may include receptacles 12 on both sides 22, 24 of the substrate 20. The receptacle assemblies 12 may be aligned with one another across the substrate 20. In the illustrated embodiment, the substrate 20 is generally horizontally positioned having upper receptacle assemblies 12 arranged on top of the substrate 20 (e.g. on the first side 22) and lower receptacle assemblies 12 arranged on the bottom of the substrate 20 (e.g. on the second side 24). The substrate 20 may have other orientations in alternative embodiments, such as, but not limited to, a vertical orientation. In an exemplary embodiment, pairs of guide rails 40 are positioned directly across the substrate 20 from one another. The fasteners 130 used to secure the guide rails 40 to the substrate 20 may optionally extend through the substrate 20 and engage both guide rails 40, which may reduce the overall number of the fasteners 130 and thus parts used to manufacture the connector assembly 10.

The guide rails 40 provide a modular guidance system for the pluggable modules 14. For example, by using substantially identical guide rails 40 on either side of the receptacle assemblies 12 and/or on either side of the substrate 20, the number of guide rail components used to manufacture the connector assembly 10 may be reduced. Additionally the complexity of the manufacture of the connector assembly 10 may be reduced. By selectively utilizing latch assemblies 42 with the guide rails 40, the overall cost of the system may be reduced as each of the guide rails 40 used within the connector assembly 10 do not necessarily include a latch assembly 42.

Figure 5:
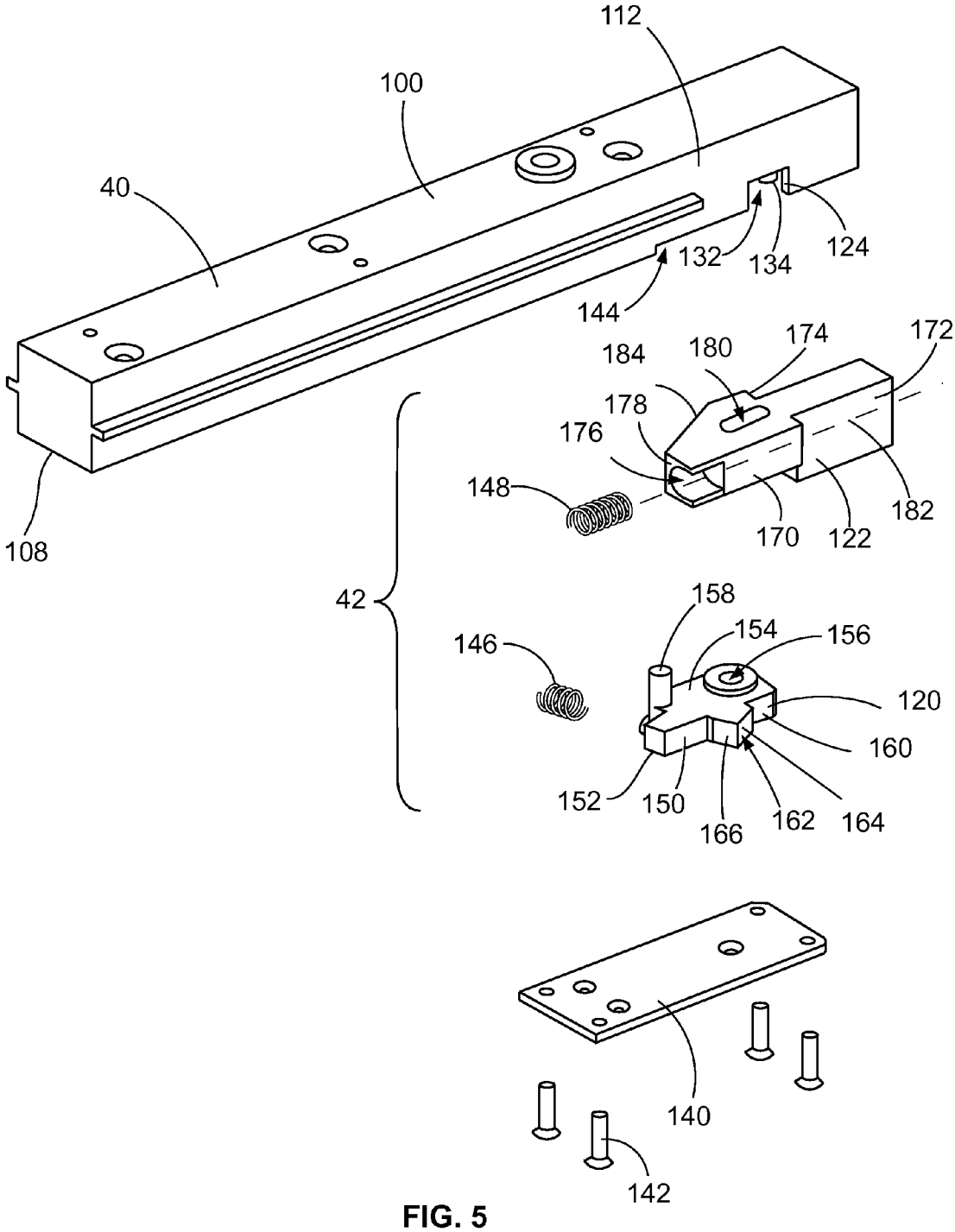
FIG. 5 is an exploded perspective view of one of the guide rails shown in FIG. 3.

FIG. 5 is an exploded perspective view of one of the guide rails 40 illustrating the components of the latch assembly 42 and a plate 140 mountable to the guide rail 40 to hold the latch assembly 42 within the guide rail 40. The plate 140 may be mounted to the rail body 100 by fasteners 142, or alternatively by different fastening means or methods. Optionally, the inner surface 108 of the rail body 100 may include a notch out 144 for receiving the plate 140. As such the plate 140 may sit flush with the inner surface 108 for mounting to the substrate 20 (see shown in FIG. 1).

The latch assembly 42 includes the latch 120 and the actuator 122. Optionally, the latch assembly 42 may also include a latch spring 146 and an actuator spring 148. As described in further detail below, the latch spring 146 may be captured between a wall of the cavity 132 and the latch 120. Similarly, the actuator spring 148 may be captured between a wall of the cavity 132 and the actuator 122. The latch spring 146 biases against the latch 120, and the actuator spring 148 biases against the actuator 122.

The latch 120 includes a generally planar latch body 150 having an inner surface 152 and an outer surface 154. The inner surface 152 generally faces the plate 140. The latch 120 includes an opening 156 extending therethrough. As will be described in further detail below, the opening 156 receives the pin 134 when the latch 120 is loaded into the cavity 132. The latch 120 includes a peg 158 extending from the outer surface 154. Optionally, the peg 158 may be cylindrical, however the peg 158 may have flat surfaces in alternative embodiments. The latch 120 includes an end wall 160 and a latch portion 162 extending outward from the end wall 160. The latch portion 162 is aligned with, and extends through, the side wall opening 124. The latch portion 162 includes a ramp surface 164 and a stop surface 166 that is generally rearward facing. As will be described in further detail below, the stop surface 166 is configured to engage the stop surface 84 of the latch detent 82 (shown in FIG. 2) to lock the pluggable module 14 within the receptacle 12 assembly (shown in FIG. 1).

The actuator 122 includes an actuator body 170 and a button 172 extending from a front 174 of the actuator body 170. Optionally, the actuator body 170 may include a spring chamber 176 at a rear 178 of the actuator body 170. The spring chamber 176 receives the actuator spring 148. The actuator body 170 includes an elongated slot 180 extending along a longitudinal axis 182 of the actuator 122. The slot 180 extends entirely through the actuator body 170 and receives the pin 134 when the actuator 122 is loaded into the cavity 132. The actuator 122 has a ramp surface 184 used for driving the peg 158 of the latch 120 as the actuator 122 is actuated.

Figure 6:
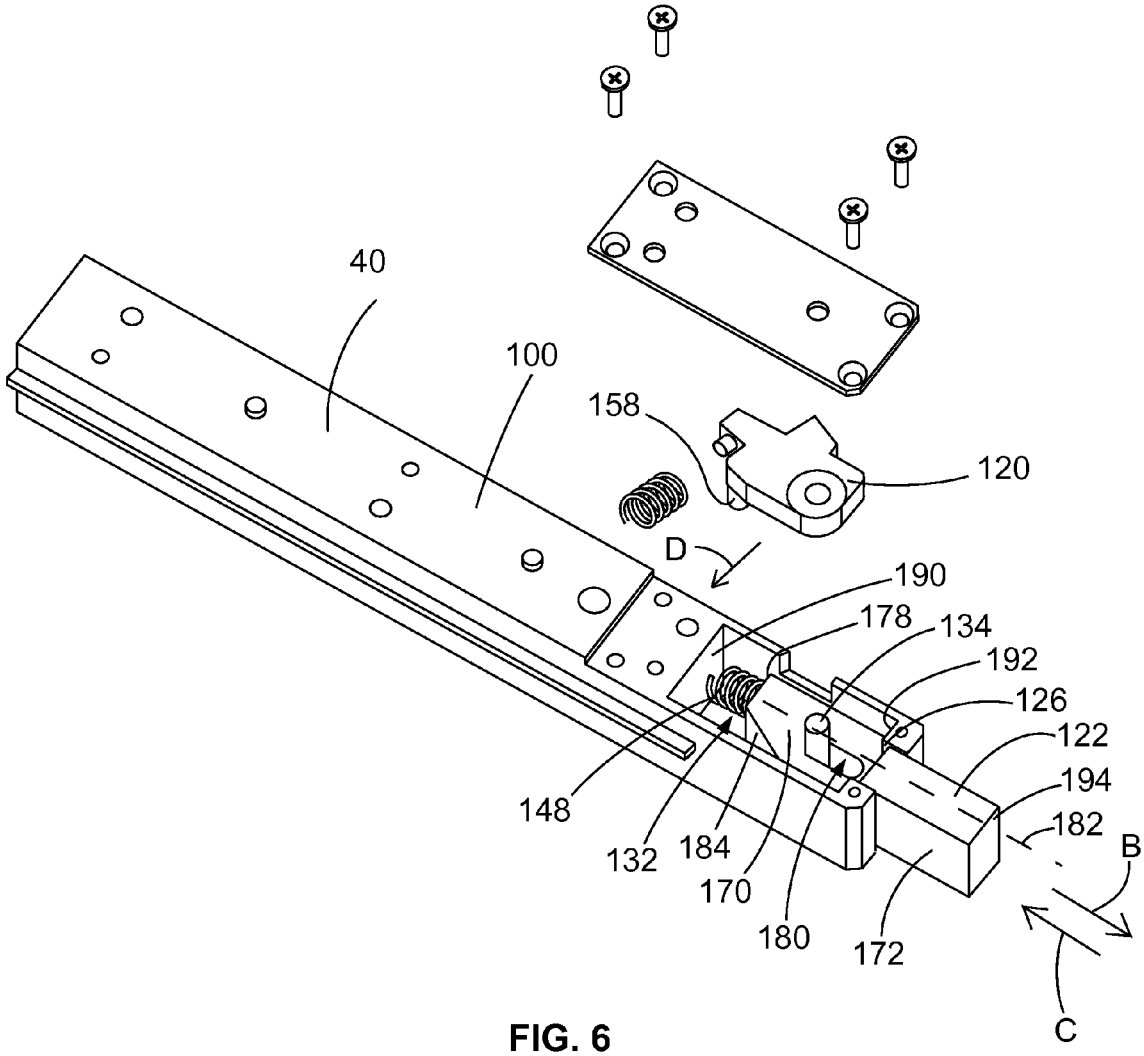
FIG. 6 is an exploded perspective view of the guide rail in a partially assembled state.

FIG. 6 is an exploded perspective view of the guide rail 40 in a partially assembled state illustrating the actuator 122 loaded into the cavity 132. When the actuator 122 is, loaded into the cavity 132, the pin 134 is received in the slot 180. The actuator spring 148 extends between the rear 178 of the actuator body 170 and a rear wall 190 of the cavity 132. The button 172 of the actuator 122 extends through the end wall opening 126 of the rail body 100. Optionally, the actuator body 170 may engage a front wall 192 of the cavity 132 to define a stop for the actuator 122. Alternatively, or additionally, the pin 134 may engage a wall defining the slot 180 to define a stop for the actuator 122.

When assembled, the actuator spring 148 generally forces the actuator 122 in an outward direction, represented by the arrow B, to a released position, such as the position illustrated in FIG. 6. In the released position, the distal end 194 of the button 172 is positioned remote from the front end 104, which allows room for the button 172 to be pressed in a pressing direction, represented by the arrow C, to an actuated position (not shown). When the button 172 is pressed, the actuator 122 moves generally along the longitudinal axis 182 toward the rear wall 190. The pin 134 guides the movement of the actuator 122. For example, the pin 134 travels through the slot 180 as the button 172 is pressed. When the button 172 is released, the actuator spring 148 generally forces the actuator 122 back to the released position.

The latch 120 may be loaded into the cavity 132 after the actuator 122 is positioned within the cavity 132. In an alternative embodiment, the latch 120 may be loaded into the cavity 132 prior to loading the actuator 122 into the cavity 132. The latch 120 is loaded into the cavity 132 such that the peg 158 is generally aligned with the ramp surface 184. When the button 172 is pressed, and the actuator 122 is driven towards the rear wall 190, the ramp surface 184 engages the peg 158. The translational movement of the actuator 122 and the ramp surface 184 generally forces the peg 158, and thus the latch 120, in an inward direction, represented in FIG. 6 by the arrow D. As will be described in further detail below, when the latch 120 is assembled, the latch 120 may be pivoted or rotated by the movement of the actuator 122 and the engagement of the ramp surface 184 with the peg 158.

Figure 7:
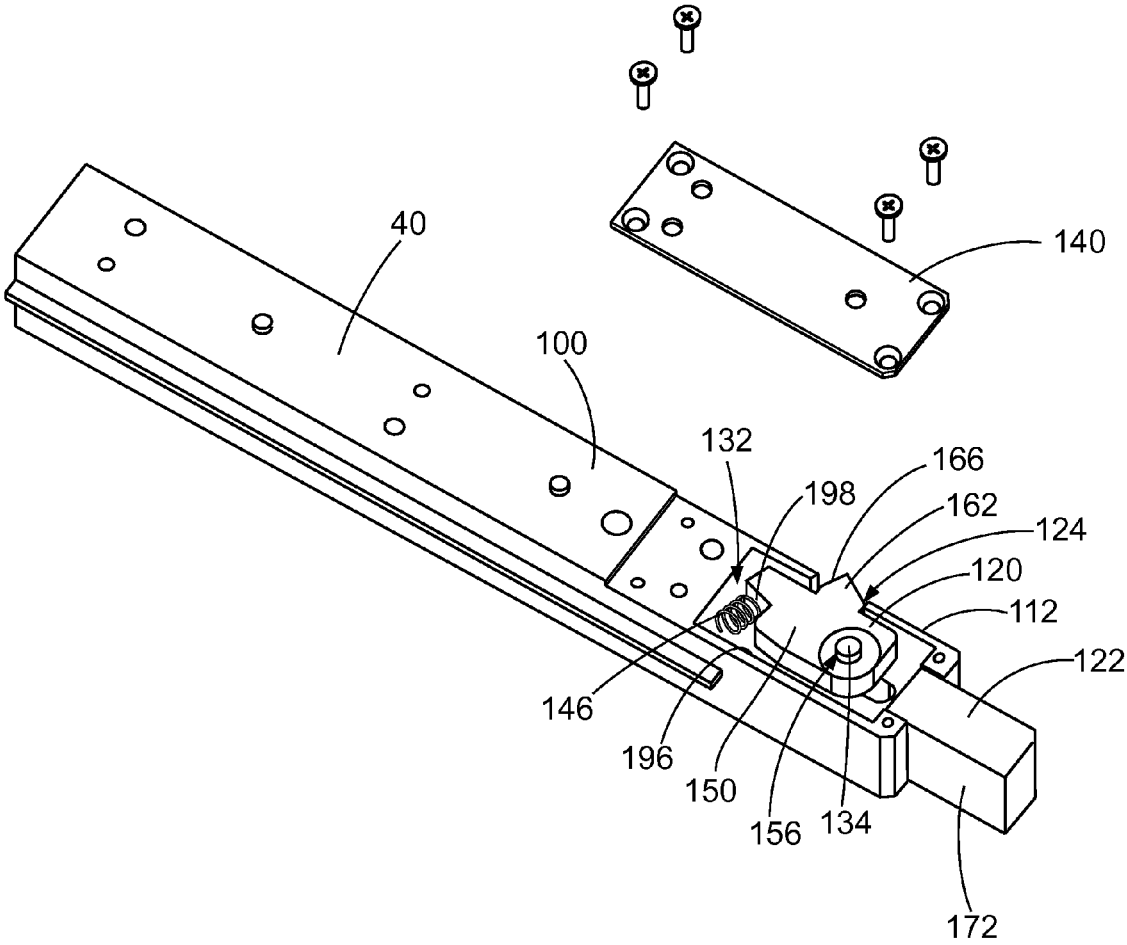
FIG. 7 is another exploded perspective view of the guide rail in a partially assembled state.

FIG. 7 is another exploded perspective view of the guide rail 40 in a partially assembled state illustrating the latch 120 within the cavity 132. Once the latch 120 is positioned within the cavity 132, the plate 140 may be secured to the rail body 100. Optionally, the latch 120 may be loaded into the cavity 132 such that the opening 156 receives the pin 134. In operation, the latch 120 is pivoted about the pin 134 between a latched position, such as the position illustrated in FIG. 7, and an unlatch position (not shown). In the latched position, the latch portion 162 extends through the side wall opening 124 and is exposed beyond the side surface 112. The latch portion 162, and more particularly the stop surface 166, is configured to engage the stop surface 84 of the latch detent 82 (shown in FIG. 2) of the pluggable module 14 to secure the pluggable module 14 within the receptacle 12. In the unlatch position, the latch portion 162 is drawn into the cavity 132 such that the stop surface 166 no longer blocks the stop surface 84 of the latch detent 82. As such, in the unlatch position, the pluggable module 14 may be removed from the receptacle 12.

As illustrated in FIG. 7, the latch spring 146 extends between the latch body 150 and a side wall 196 of the cavity 132. Optionally, a protrusion 198 may extend from the latch body 150. The latch spring 146 surrounds the protrusion 198 and is held in place relative to the latch 120 by the protrusion 198. The latch spring 146 is biased against the latch body 150 to generally force the latch 120 into the latched position. The bias force of the latch spring 146 may be overcome by actuation of the actuator 122. For example, as described above, when the button 172 is pressed, the ramp surface 184 (shown in FIG. 6) engages the peg 158 (shown in FIG. 6) to generally force the latch outward towards the side wall 196. The latch 120 is pivoted about the pin 134 from the latched position to the unlatch position. When the button 172 is released the latch spring 146 generally forces the latch 120 to move from the unlatch position to the latched position. Optionally, as the latch spring 146 forces the latch 120 to the latched position, the peg 158, may ride down the ramp surface 184 of the actuator 122 to generally force the actuator 122 to the released position. Optionally, the action of the peg 158 on the ramp surface 184 may be enough to force the actuator 122 to the released position without the use of the actuator spring 148. In an alternative embodiment, biasing elements other than springs may be used to replace the latch spring 146 and/or the actuator spring 148.

A connector assembly is thus provided that uses guide rails having integral latch assemblies to lock a pluggable module within a receptacle assembly. The guide rails are modular and may be used on both sides of the receptacle for guidance for the pluggable modules. The guide rails may be provided on both sides of a substrate and secured either to the substrate or to another guide rail on the opposite side of the substrate. The latch assemblies are housed within the guide rail and may have a form factor that is no larger than the form factor of the guide rail, thus having minimal impact on the overall size of the connector assembly. The latch assemblies have a latch and an actuator that moves the latch from a latched position to an unlatched position so that the pluggable module may be removed. The latch is pivoted by the actuator to provide a simple range of motion. The pivoting of the latch also allows the latch to return to the latched state in a reliable manner, such as by using a spring to bias the latch to the latched position. The actuator may also be biased to a normal, released position by a spring. The latching system reduces complexity by limiting the latching components to the guide rail as opposed to the pluggable module. Additionally, the latch assembly may be selectively mounted within the guide rails, such that each guide rail in the connector assembly does not necessarily need to include a latch assembly, which may reduce the overall cost and complexity of the connector assembly.

It is to be understood that the above description is intended to be illustrative, and not restrictive. For example, the above-described embodiments (and/or aspects thereof may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly for mating with a pluggable module, the connector assembly comprising:

a receptacle assembly for receiving the pluggable module;

an interface electrical connector defining a back of the receptacle assembly, the interface electrical connector being configured to mate with the pluggable module;

a guide rail defining a side of the receptacle assembly, the guide rail being configured to guide the pluggable module within the receptacle assembly, the guide rail having a rail body extending along a rail axis between a front end and a back end, the rail body having a cavity and the rail body having a side wall opening open to the cavity, the guide rail includes a pin extending into the cavity; and a latch assembly received in the cavity, the latch assembly includes a latch movable between a latched position and an unlatched position, the latch being pivoted between the latched position and the unlatched position about the pin extending into the cavity from the rail body, the latch being configured to extend through the side wall opening to engage the pluggable module when the latch is in the latched position, the latch assembly further includes an actuator extending from the front end of the rail body, the actuator includes an elongated slot that receives the pin, the actuator being actuated in a linear actuation direction along the rail axis to force the latch from the latched position to the unlatched position, the pin guiding the actuator in the linear actuation direction.

2. The connector assembly of claim 1, wherein the latch is configured to lock the pluggable module within the receptacle assembly when the latch is in the latched position.

3. The connector assembly of claim 1, further comprising a second guide rail defining an opposite side of the receptacle assembly, the second guide rail being substantially identically formed as the other guide rail.

4. The connector assembly of claim 3, wherein the second guide rail has a first side and a second side, the first side faces the other guide rail and is configured to guide the pluggable module within the receptacle assembly, the second side defines a side of a second receptacle assembly and is configured to guide a second pluggable module within the second receptacle assembly.

5. The connector assembly of claim 1, further comprising a substrate having a first side and a second side, the first side defining a side of the receptacle assembly, the second side defining a side of a second receptacle assembly arranged directly opposite to the other receptacle, a second guide rail being mounted to the second side of the substrate directly opposite to the other guide rail, a fastener extending through the substrate to couple both the guide rail and the second guide rail to the substrate.

6. The connector assembly of claim 1, wherein the latch includes a peg extending outward therefrom, the actuator includes a ramp surface, the peg rides along the ramp surface as the actuator is actuated to move the latch relative to the side wall opening.

7. The connector assembly of claim 1, wherein the actuator is movable between a released position and an actuated position, the actuator moves the latch to the unlatched position as the actuator is moved from the released position to the actuated position, and wherein at least one of the actuator and the latch are spring biased to force the latch to the latched position and the actuator to the released position.

8. The connector assembly of claim 1, wherein the actuator includes a distal end and a rear, the distal end being exposed beyond the front end of the rail body, the rear interfacing with the latch to move the latch between the latched and unlatched positions.

9. A guide rail for guiding a pluggable module, the guide rail comprising:

a rail body extending along a rail axis between a front end and a back end, the rail body having a cavity proximate to the front end and the rail body having a side wall opening open to the cavity, the rail body includes a pin extending into the cavity; and a latch assembly received in the cavity, the latch assembly includes a latch movable between a released position and a latched position, the latch being pivoted between the latched position and the unlatched position about the pin, the latch being configured to extend through the side wall opening to engage the pluggable module in the latched position, the latch assembly further includes an actuator extending from the front end of the rail body, the actuator includes an elongated slot that receives the pin, the actuator being actuated in a linear actuation direction along the rail axis to force the latch from the latched position to the released position, the pin guiding the actuator in a linear actuation direction.

10. The guide rail of claim 9, wherein the latch includes a peg extending outward therefrom, the actuator includes a ramp surface, the peg rides along with a ramp surface as the actuator is actuated to move the latch relative to the side wall opening.

11. The connector assembly of claim 9, wherein the actuator includes a distal end and a rear, the distal end being exposed beyond the front end of the rail body, the rear interfacing with the latch to move the latch between the latched and unlatched positions.

12. A connector assembly for mating with pluggable modules, the connector assembly comprising:

a substrate having a first side and a second side;

interface electrical connectors mounted to the substrate, the interface connectors being configured to mate with pluggable modules;

first, second and third guide rails mounted to the first side of the substrate, a first receptacle assembly being defined between the first and second guide rails, and a second receptacle assembly being defined between the second and third guide rails, the guide rails being configured to guide the pluggable modules to the interface connectors, each said guide rail having a rail body having a cavity and the rail body having a side wall opening open to the cavity; and latch assemblies received in corresponding said cavities, each said latch assembly includes a latch movable between a latched position and an unlatched position, the latch being configured to extend through the corresponding side wall opening to engage the corresponding pluggable module, the latch of the latch assembly associated with the first guide rail extending into the first receptacle assembly, and the latch of the latch assembly associated with the second guide rail extending into the second receptacle assembly, each said latch assembly further includes an actuator that forces the latch from the latched position to the unlatched position;

wherein each said guide rail includes a pin extending into the cavity, each said actuator includes an elongated slot that receives the corresponding pin, the pin guiding the actuator in a linear actuation direction, and wherein each said latch is pivoted between the latched position and the unlatched position about the corresponding pin.

13. The connector assembly of claim 12, wherein the rail body of the second guide rail includes a first side defining the first receptacle assembly and a second side defining the second receptacle assembly, both the first and second sides being configured to engage corresponding pluggable modules loaded into the first and second receptacle assemblies, respectively.

14. The connector assembly of claim 12, wherein each actuator includes a distal end and a rear, the distal end being exposed beyond a front end of the rail body, the rear interfacing with the latch to move the latch between the latched and unlatched positions.

* * * * *